US010161370B2

(12) United States Patent
Sarwar et al.

(10) Patent No.: US 10,161,370 B2
(45) Date of Patent: Dec. 25, 2018

(54) SYSTEMS AND METHODS FOR PERFORMING PROGNOSIS OF FUEL DELIVERY SYSTEMS

(71) Applicant: GM GLOBAL TECHNOLOGY OPERATIONS LLC, Detroit, MI (US)

(72) Inventors: Azeem Sarwar, Rochester Hills, MI (US); Chaitanya Sankavaram, Sterling Heights, MI (US); Rafat Hattar, Royal Oak, MI (US); Matthew Hamilton, Novi, MI (US); Jonathan Pung, Auburn Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 372 days.

(21) Appl. No.: 15/097,644

(22) Filed: Apr. 13, 2016

(65) Prior Publication Data

US 2017/0298883 A1 Oct. 19, 2017

(51) Int. Cl.

| | |
|---|---|
| ***F02M 59/36*** | (2006.01) |
| ***F02D 41/38*** | (2006.01) |
| ***F02M 59/46*** | (2006.01) |
| ***F02D 41/14*** | (2006.01) |
| *F02D 41/22* | (2006.01) |

(52) U.S. Cl.

CPC ..... *F02M 59/368* (2013.01); *F02D 41/1401* (2013.01); *F02D 41/3845* (2013.01); *F02M 59/367* (2013.01); *F02M 59/464* (2013.01); *F02M 59/466* (2013.01); *F02D 2041/1412* (2013.01); *F02D 2041/1422* (2013.01); *F02D 2041/224* (2013.01); *F02D 2041/228* (2013.01); *F02M 59/366* (2013.01)

(58) Field of Classification Search

CPC .. F02M 59/466; F02M 59/464; F02M 59/366; F02M 59/368; F02M 59/367; F02D 41/3845; F02D 41/221; F02D 2250/31; F02D 2041/224; F02D 41/22; F02D 41/20; F02D 2041/228; Y02T 10/44; F02C 9/263

See application file for complete search history.

(56) References Cited

U.S. PATENT DOCUMENTS 4,879,673 A * 11/1989 Nagase ..... F02D 41/22 702/100

5,937,826 A * 8/1999 Olson ..... F02D 41/221 123/198 D (Continued)

*Primary Examiner* — Sizo Vilakazi
*Assistant Examiner* — Brian Kirby
(74) *Attorney, Agent, or Firm* — Quinn IP Law

(57) ABSTRACT

An engine fuel delivery system includes a fuel pump having a pumping chamber to increase fuel pressure and a closeable inlet valve, and a fuel rail to communicate pressurized fuel received from the fuel pump to at least one engine cylinder. The engine fuel delivery system also includes a controller programmed to issue a control signal to periodically close the inlet valve to generate a setpoint fuel pressure within the pumping chamber. The controller is also programmed to adjust a control signal gain value in response to deviation in an outlet fuel pressure relative to the setpoint fuel pressure. The controller is further programmed to issue a warning message in response to the control signal gain being adjusted by more than a predetermined threshold from a calibrated gain value.

17 Claims, 3 Drawing Sheets

(56) References Cited

U.S. PATENT DOCUMENTS 6,076,504 A * 6/2000 Stavnheim ..... F02D 41/221 123/198 D
6,378,501 B1 * 4/2002 Hisato ..... F02D 41/3863 123/458
6,446,610 B1 * 9/2002 Mazet ..... F02D 41/3818 123/357
6,712,045 B1 * 3/2004 McCarthy, Jr. ..... F02D 41/0087 123/456
6,871,633 B1 * 3/2005 Date ..... F02D 33/006 123/445
8,055,460 B2 11/2011 Rajagopalan et al.
2001/0006061 A1 * 7/2001 Shimada ..... F02D 41/062 123/495
2003/0127082 A1 * 7/2003 Takahashi ..... F02D 41/221 123/704
2004/0055575 A1 * 3/2004 McCarthy, Jr. ..... F02D 41/1498 123/457
2004/0055576 A1 * 3/2004 McCarthy, Jr. ..... F02D 41/0087 123/458
2005/0045158 A1 * 3/2005 Takahashi ..... F02D 13/0219 123/506
2006/0147317 A1 * 7/2006 Okamoto ..... F02D 41/3845 417/297
2007/0079809 A1 * 4/2007 Oono ..... F02D 41/3845 123/456
2007/0186908 A1 * 8/2007 Fukasawa ..... F02D 41/08 123/458
2010/0211291 A1 * 8/2010 Sumitani ..... F02D 41/0085 701/104
2014/0165970 A1 * 6/2014 Lee ..... F02D 41/221 123/495
2015/0106040 A1 * 4/2015 Methil ..... F02M 65/006 702/51
2015/0144108 A1 * 5/2015 Kim ..... F02M 69/54 123/460
2016/0084190 A1 * 3/2016 Nistler ..... F02D 41/3845 123/456

* cited by examiner

SYSTEMS AND METHODS FOR PERFORMING PROGNOSIS OF FUEL DELIVERY SYSTEMS

TECHNICAL FIELD

The present disclosure relates to vehicle powertrain fuel delivery.

INTRODUCTION

Fuel delivery to an internal combustion engine affects engine performance and may be regulated by one or more fuel pumps to draw fuel from a tank. A number of components arranged between the fuel tank and an engine combustion chamber facilitate precise delivery of fuel to the engine. Failure of any of the intermediate components can affect proper fuel delivery and degrade engine performance.

SUMMARY

An engine fuel delivery system includes a fuel pump having a pumping chamber to increase fuel pressure and a closeable inlet valve. The fuel delivery system also includes a fuel rail to communicate pressurized fuel received from the fuel pump to at least one engine cylinder. The engine fuel delivery system further includes a controller programmed to issue a control signal to periodically close the inlet valve to generate a setpoint fuel pressure within the pumping chamber. The controller is also programmed to adjust a control signal gain value in response to deviation in an outlet fuel pressure relative to the setpoint fuel pressure. The controller is further programmed to issue a warning message in response to the control signal gain being adjusted by more than a predetermined threshold from a calibrated gain value.

A method of conducting fuel pump prognosis includes issuing a control signal to periodically actuate a fuel pump solenoid valve based on an engine RPM. The method also includes applying a gain value to the control signal to change a timing of actuation of the fuel pump solenoid based on a fuel output pressure setpoint corresponding to engine fuel demand. The method further includes adjusting the gain value in response to fuel output pressure deviating from the pressure setpoint. The method further includes issuing an imminent failure warning message in response to the gain value being adjusted by more than a predetermined threshold.

A direct-inject fuel pump prognosis system includes a solenoid inlet valve operable to regulate a fuel inlet flow into the fuel pump and a sensor to provide a pressure signal indicative of fuel pressure downstream of the fuel pump. The fuel pump prognosis system also includes a controller programmed to issue a control signal to actuate the solenoid inlet value to create a pressure rise within the fuel pump to satisfy an engine demand. The controller is also programmed to adjust a control signal gain value based on the pressure signal from the sensor. The controller is further programmed to issue a prognosis message indicative of a fuel pump state of health based on the control signal gain value.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
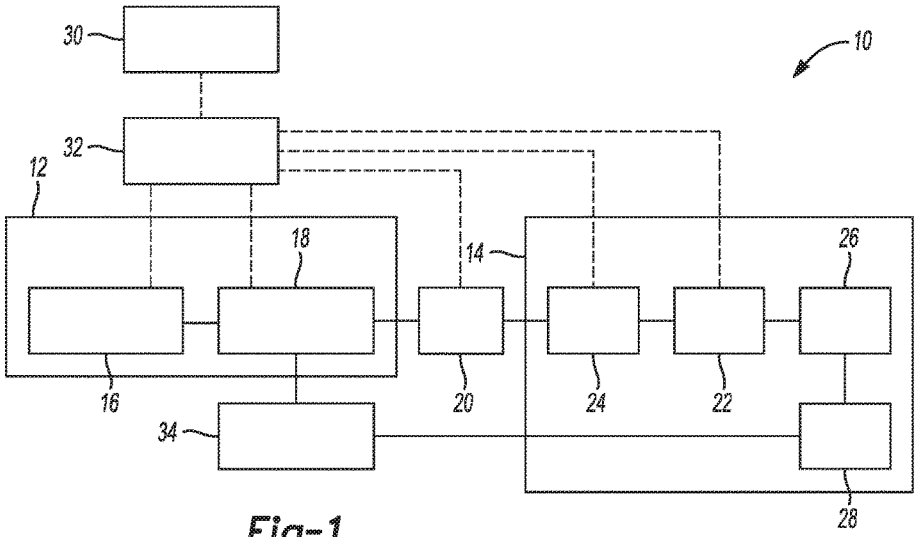
FIG. 1 is a block diagram of a fuel delivery system.

Referring to FIG. 1, an internal combustion engine fuel delivery system 10 provides fuel for an engine 14. The fuel delivery system 10 may provide fuel to the engine 14 in the form of gasoline and/or ethanol in various percentages. In the example provided, the fuel delivery system 10 is a high-pressure direct injection system. Fuel is pressurized prior to delivery to the engine 14. A low-pressure fuel supply pump 16 draws fuel from a reservoir portion of the fuel tank 12 to supply the fuel to a high-pressure fuel pump 18. A pressure rise is created within the high-pressure pump 18 and the pressurized fuel is communicated through a fuel rail 20 to each of a plurality of cylinders 22 of the engine 14. While FIG. 1 depicts a single cylinder as a representation, the engine 14 may include any number of cylinders based on the engine configuration. A plurality of cylinders 22 may be arranged in separate groups, or banks. Alternatively, the cylinders 22 may be arranged in an inline orientation.

Each cylinder 22 receives pressurized fuel from the fuel rail 20 and the fuel is dispersed into the cylinder by a fuel injector 24. Air is also supplied to each cylinder 22 through an air valve (not shown) to be mixed with the pressurized fuel to create a desirable fuel-to-air ratio to facilitate optimal fuel combustion. The combustion within each cylinder 22 drives a piston 26 which in turn rotates crankshaft 28 to output torque from the engine. According to aspects of the disclosure, pressurized fuel from each injector 24 is directly sprayed into a corresponding cylinder 22 to mix with air once inside of the cylinder as opposed to being pre-mixed before injection. Direct injection of pressurized fuel into the cylinders enhances the ability to send precise amounts of fuel to the cylinders at exact timing intervals. The high-pressure pump 18 may generate fuel pressure delivered to the fuel rail 20 at up to about 2,500 psi. The high-pressure fuel pump 18 is driven by a camshaft 34 and is operable to vary the fuel output to satisfy engine demand. The camshaft 34 is mechanically linked to the crankshaft 28 such that the rotational speed of each shaft is related to the rotations per minute (RPM) of the output of engine 14.

The various fuel delivery components discussed herein may have one or more associated controllers to control and monitor operation. Controller 32, although represented as a single controller, may be implemented as one controller, or as system of controllers in cooperation to collectively manage fuel delivery. Multiple controllers may be in communication via a serial bus (e.g., Controller Area Network (CAN)) or via discrete conductors. In further examples, at least a portion of the control function is performed by an off-board processing element which is external to the vehicle. The controller 32 is programmed to coordinate the operation of the various fuel delivery components. The fuel demand of the engine 14 required to output torque varies based at least on driver demand indicated by input at an accelerator pedal 30. An accelerator pedal sensor provides a pedal position signal to the controller 32. In the case of an autonomous or self-driving vehicle, throttle position information may be provided to the controller 32 in lieu of a pedal position influenced by a driver. The controller 32 also monitors operating conditions of the low-pressure supply fuel pump 16, the high-pressure fuel pump 18, fuel rail 20, fuel injectors 24, and/or the cylinders 22. The low-pressure fuel supply pump 16 may include sensors to provide the controller 32 with information regarding the amount of fuel supplied to the high-pressure fuel pump 18. The high-pressure fuel pump 18 includes one or more sensors, discussed in more detail below, which provide feedback information to the controller 32 regarding pump operation. According to aspects of the present disclosure, fuel outlet pressure is measured by a pressure sensor directly at the outlet of the high-pressure pump 18. The controller may also be in communication with one or more additional pressure sensors along the fuel rail 20 to monitor fuel pressure at other locations in the fuel delivery system 10. In addition, the controller 32 may determine the desired fuel pressure for delivery to the engine as a pressure setpoint.

Figure 2:
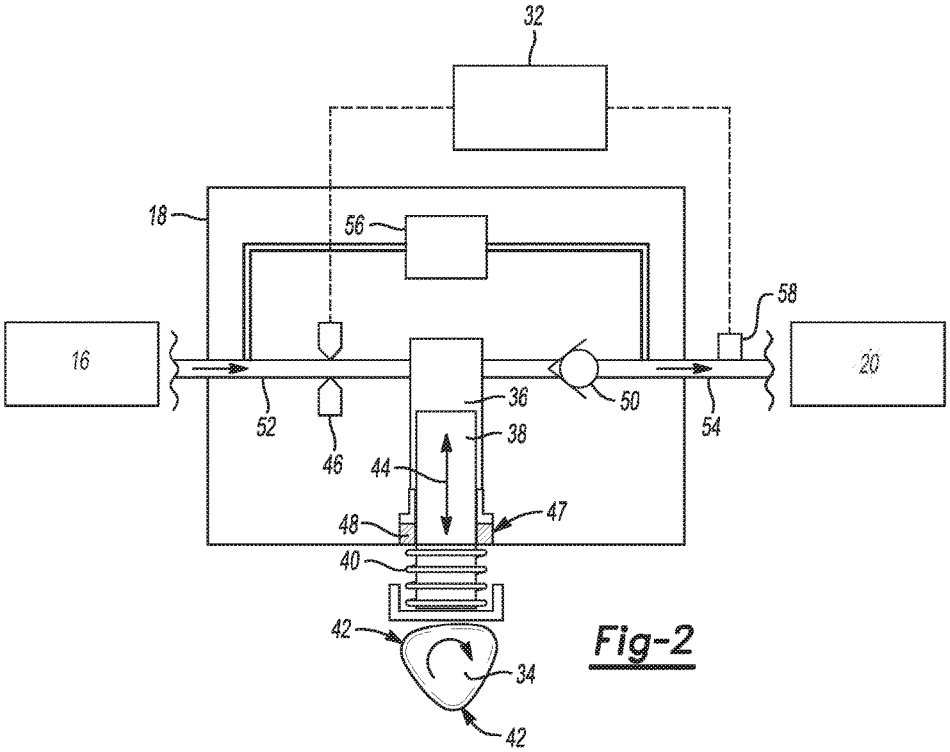
FIG. 2 is a schematic view of a high pressure fuel pump.

Referring to FIG. 2, the high-pressure fuel pump 18 is shown in more detail. The high-pressure pump 18 is a standalone unit and is mechanically actuated. The high-pressure fuel pump 18 includes a pumping chamber 36 to accumulate a pressure rise in fuel within the chamber. The pump may be directly or indirectly driven by engine output. A camshaft 34 drives the high-pressure pump and is operatively coupled to the output rotation of the engine 14. A plunger 38 is biased against the camshaft 34 by a spring 40. The rotation of the camshaft 34 actuates the high-pressure fuel pump 18 when one or more lobes 42 of the camshaft 34 reciprocally actuate the plunger 38 along an actuation direction depicted by arrow 44. In one example, the camshaft 34 defines a three-lobe cam such that the high-pressure fuel pump cycles at a proportionally higher rate relative to output RPM of the engine. As the plunger 38 moves the available volume within the pumping chamber 36 changes, either allowing fuel to be drawn in, or forcing fuel to be expelled following the pressure rise. In alternate examples, the high-pressure pump 18 may be driven by gears or toothed belts. Additionally, the high-pressure pump may be hydraulically actuated using fluid flow of engine oil or fuel.

There are generally two operation states for the high-pressure fuel pump 18. First, a suction stroke causes low-pressure fuel to be drawn into the pumping chamber 36 from the supply pump 16. A solenoid inlet valve 46 is used to control fuel entering into the pumping chamber 36 based on the desired pressure increase, or target pressure setpoint. In one example, the solenoid valve 46 is configured to be normally open when de-energized. However it is contemplated that the reverse configuration of a solenoid valve may be used where the valve is normally closed when de-energized. In either case, the valve is caused to remain open during the suction stroke to allow fuel to flow into the pumping chamber 36.

As the camshaft 34 rotates, the plunger 38 is actuated to compress the fuel within the pumping chamber 36 to increase fuel pressure. Specifically, as the camshaft lobe 42 rotates to cause the plunger 38 to rise to a maximum position, the plunger 38 reduces the volume within the pumping chamber 36, compressing fuel present inside the pump. The plunger 38 is sealed to an opening 47 through a portion of the pumping chamber 36 by one or more seals 48. In one example, the seal 48 is arranged as a sleeve surrounding the plunger 38. In alternative examples, the seal may be configured as an o-ring seal.

In order to facilitate the pressure rise, the solenoid valve 46 is energized (or conversely de-energized) to close off fuel flow between the low-pressure fuel pump 16 and the pumping chamber 36 when the fuel is compressed. Once pressure within the pumping chamber 36 builds to a sufficient level which exceeds a pressure threshold, the fuel flow overcomes a check valve 50 allowing the pressurized fuel to exit the pump 18 and be delivered to the fuel rail 20.

The pressure rise generated within the pumping chamber 36 may be generally described by equation (1) below.

$$\frac{dP}{dt} = \frac{B \cdot (Q_{in} - Q_{out} - Q_{leak})}{V(t)} \tag{1}$$

As noted in equation (1), V(t) is the volume of the pumping chamber 36 as a function of time. B is the bulk modulus of the fuel within the pump 18. $Q_{in}$ is the flow rate into the pump through inlet fuel line 52. $Q_{out}$ is the outlet flow rate through the check valve 50 and outlet fuel line 54. $Q_{leak}$ is the loss flow rate due to fuel pump leakage, for example from a degraded seal (e.g., seal 48).

The timing of the closing of the inlet solenoid valve 46 has a significant effect upon the amount of pressure rise developed within the pumping chamber 36. That is, there is a relationship between pump pressure, position of camshaft 34, and the state of the inlet solenoid valve 46. These elements influence fuel pulses of the injectors 24 and can be calibrated to provide optimal performance and component life. Controller 32 is programmed to issue control signals to periodically close the inlet solenoid valve 46 at the exact time required to build desired pressure corresponding to demand of engine 14. By precisely controlling the inlet solenoid valve 46 timing, the controller 32 may influence both of the volume and fuel outlet pressure for each pulse. When direct injection is operating properly, the high-pressure fuel pump rapidly and precisely pulses fuel to the injector to create the most optimal fuel-to-air mixture.

A relief valve 56 is provided as an internal return line to compensate for excessive pressure created by the high-pressure fuel pump 18. The relief valve 56 is in fluid flow connection to the outlet fuel line 54 downstream of the check valve 50. In response to pressure in the outlet fuel line 54 exceeding a pressure limit threshold, the relief valve 56 opens and returns fuel to the inlet fuel line 52.

The response time of the actuation of the solenoid valve may be degraded by a number of factors. Solenoid wear may cause increased mechanical resistance opposing the actuation of the solenoid valve. The controller may be programmed to automatically adjust control signal gain to change the actuation timing of the solenoid valve. In one example, the control signal gain is increased to alter the timing of the solenoid valve to open it sooner to capture a desired amount of fuel within the pumping chamber. However there may be a limit to the timing adjustment that may be applied to the solenoid valve to compensate for wear. At some point, continually opening the solenoid valve sooner no longer improves response time for overcoming wear issues.

A second cause of degraded response time of the solenoid valve may be leakage of the high-pressure fuel pump. As discussed above, loss in fuel pressure may be caused by degradation in the seals between the plunger and the pumping chamber. As fuel leaks past the plunger and escapes the high-pressure pump, a pressure drop is caused in the pumping chamber. Due to the leakage, the solenoid valve may need to be held open longer to allow more fuel to accumulate within the chamber. Referring back to equation (1) above, $Q_{in}$ may be increased in order to compensate and maintain the same pressure rise in the pumping chamber in spite of a fuel pump leak. The controller may be programmed to automatically adjust the control signal gain to modify the open time of the solenoid valve to compensate for leakage. In this case the control signal gain may be adjusted in order to increase the solenoid valve open time duration during a cycle.

Referring back to FIG. 2, the controller 32 is programmed to receive a pressure signal from a sensor 58 which is indicative of fuel pressure downstream of the fuel pump 18. In one example, the sensor 58 is arranged to read pressure of the fuel outlet flow through the outlet fuel line 54. In other examples, the pressure of the flow through the fuel rail 20 may be sensed to provide the controller 32 with information about fuel pump 18 performance. The controller 32 is further programmed to adjust a control signal gain value based on the pressure signal from the sensor 58. The controller 32 may adjust the control signal gain value in response to deviation in the outlet fuel pressure relative to the fuel pressure setpoint.

In one example, if fuel pump output fuel pressure deviates from the pressure setpoint by a shutdown threshold value, the controller 32 may recognize a severe fault and cause a deactivation of the high-pressure fuel pump 18. In this case, the powertrain may operate in a low-pressure "limp" mode where the inlet solenoid valve 46 is caused to remain open such that fuel is provided to the fuel rail 20 under pressures as delivered by the low-pressure supply pump 16. As discussed above, the valve may be configured to remain open while de-energized or alternatively require energy to remain in the open state. In the limp mode, the powertrain remains operable, but engine 14 performance is reduced.

If a deviation in the pressure rise created by the high-pressure pump 18 deviates from the pressure setpoint by less than the shutdown threshold, the controller 32 may operate the pump 18 utilizing modified control gains to adjust solenoid 46 timing to maintain the fuel outlet pressure as close to the pressure setpoint as possible. However, such deviations may be an indication of degrading performance of the high-pressure fuel pump 18 and ultimately pump failure. According to aspects of the present disclosure, the control gains applied to the high-pressure fuel pump 18 to optimize operation may be used to conduct a prognosis of the operational life of the fuel pump. The controller 32 may be further programmed to provide an owner and/or service technician with any of a number of messages about the operational life of the high-pressure pump 18. Further, the type of gain adjustment may correspond to a particular type of failure mode and enhance the available specificity of the message generated.

Figure 3:
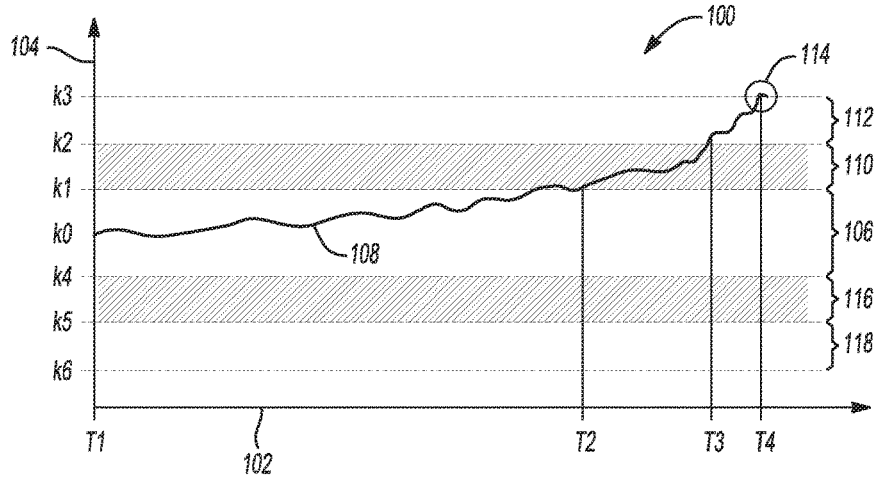
FIG. 3 is a plot of control signal gain versus solenoid valve response time.

Referring to FIG. 3, plot 100 depicts degraded performance of a high-pressure fuel pump. Horizontal axis 102 represents response time of the solenoid valve. The vertical axis 104 represents control gains as applied by the controller based on compensating for degradation in response time of the solenoid valve. Curve 108 represents adjustments in the gain value k with respect degradations in solenoid response time. A new solenoid valve may have a baseline response time T1 at optimal component performance. For a healthy pump, the timing of the solenoid opening and closing to deliver necessary fuel is determined by an initial calibration. In this case a nominal gain k0 corresponding to a calibrated gain value is applied to the control signal. According to an example, the calibrated gain value is set based on fuel demand corresponding to normalized engine operating conditions when the fuel pump is new.

As discussed above, the controller is programmed to adjust the gain value of the control signal based on the output pressure of the high-pressure fuel pump deviating from the pressure setpoint. The adjustment compensates for changes in pump performance over time in order to deliver necessary fuel output to match the pressure setpoint. In the example of FIG. 3, the gain value k is increased to compensate for increased solenoid response time. In alternate embodiments the gain may be decreased to achieve a desired effect on fuel delivery system operation.

The controller may be programmed to issue a fuel delivery system state of health message based on the value of the control signal gain k applied to the solenoid valve. When the applied control system gain is within a nominal region such as gain region 106, the message may be indicative of a properly functioning fuel delivery system. The state of health message may include information about the remaining useful life of various fuel system components. The state of health message may be provided to a driver via a user display in the vehicle. Alternatively, the state of health message may be provided by an external processor portion of the controller and sent to a user's mobile device, a user's computer, a vehicle service sever, or any number of different external processors.

The controller is also programmed to issue a first warning message in response to the control signal gain k being adjusted by more than a predetermined threshold amount from the calibrated gain value k0 . With continued reference to the example of FIG. 3, the first warning message is issued in response to the control signal adjusted to a value greater than a gain value k1 that is outside of a threshold gain region 106. The gain value k1 corresponds to a degraded solenoid response time T2 . The first warning message issued while the control signal gain is within a region 110 (between k1 and k2) may indicate a need to service one or more components of the fuel delivery system soon.

If repair service is not performed and the solenoid response time continues to increase, a more severe message is issued that is indicative of an imminent failure. The controller is programmed to issue an imminent failure warning message in response to the gain value deviating from the calibrated gain value by a predetermined threshold amount. In the example of FIG. 3, the imminent failure warning message is issued when the control signal gain exceeds k2 which corresponds to a solenoid response time T3 . The gain value within the range indicated by gain region 112 (between k2 and k3) represents an operating band within which the imminent failure warning message is issued. The imminent failure message may have increased urgency conveyed to an owner of the vehicle regarding the need for service of the fuel delivery system. In alternative embodiments, an imminent failure message is sent directly to a service center to follow up with the vehicle owner.

In the continued absence of service, the gain value k may continue to be adjusted corresponding to a degraded solenoid response time. However there is an upper limit to which the gain value may be adjusted and maintain solenoid valve operation. For example, a critical gain value k3 is the failure threshold where the solenoid becomes inoperable. At operating conditions at about location 114, the fuel pump may fail due to requiring gain values outside of the authority of the controller. In one example the controller may deactivate the high-pressure fuel pump and enter limp home mode as discussed above, delivering fuel by the supply fuel pump only.

Although the plot of FIG. 3 depicts the gain value increasing to compensate for solenoid performance, it should be appreciated that certain operating conditions may cause the gain value to be reduced below the calibrated gain value k0 . Similar to previous examples, a warning message issued while the control signal gain is within a region 116 (between k4 and k5 ) may indicate a need to service the fuel delivery system soon. Likewise, a gain value within the range indicated by region 118 (between k5 and k6 ) represents an operating band within which an imminent failure warning message is issued.

While a first warning message is discussed as preceding an imminent failure message, it is contemplated that any number of varying degree severity messages may be generated based on the trends of control signal gains applied to the fuel delivery system. For example, multiple levels of warnings may be provided prior to generating an imminent failure message, where each level may include a different severity indicator. Further, different severity warning messages may have a specific combination of one or more recipients such as a driver, service technician, vehicle fleet operator, or vehicle manufacturer for example.

Figure 4:
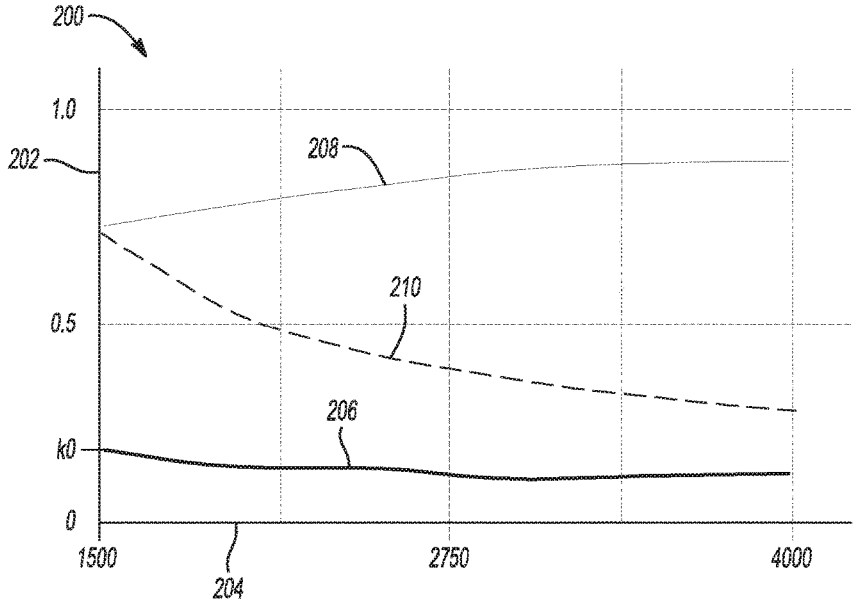
FIG. 4 is a plot of control signal gain versus engine RPM.

Referring to FIG. 4, the controller may be further programmed to monitor other fuel delivery system operation data to provide more detailed prognoses of the lifespan of individual components within the fuel delivery system. Specifically, the behavior of the control system gain adjustments may indicate degraded performance of certain components or modules. For example, the direction of control signal gain value trends with respect to engine RPM may differ depending on which component has degraded. Plot 200 of FIG. 4 shows control signal gain trends under different operating scenarios. The vertical axis 202 is the gain value applied by the controller of the high-pressure fuel pump. The horizontal axis 204 represents engine RPM.

Curve 206 represents the control signal gain applied to a healthy fuel pump where the gain value is insensitive to changes in engine RPM. That is, the control system gain value of the high-pressure fuel pump remains relatively constant at a calibrated gain value k0 across a range of engine RPM values when the fuel pump is operating properly.

Curve 208 reflects an adjustment trend of the control signal gain values in the case of a worn solenoid exhibiting a response time increase of about 50%. As demonstrated by the shape of curve 208, the control system gain value increases as engine RPM increases when the solenoid is degraded from wear. As engine speed increases and more fuel is demanded, the gain value is more sensitive to a slower operating solenoid—thus the controller increases the gain value to compensate. This trend may be used by the controller to generate a more detailed prognosis message. In one example, the prognosis message is indicative of solenoid degradation or imminent failure when the control gain value increases to satisfy engine demand as engine RPM increases.

Comparatively, curve 210 represents an adjustment trend of the control signal gain value in the case of a leaking plunger sleeve seal. Assuming a steady state rate of leakage from the fuel pump, the gain becomes less sensitive to the leakage as the speed of pulsation of the pump increases. Said another way, there is less time between each cycle for fuel to leak from the pumping chamber 36. In effect the gain value decreases as engine RPM increases, as shown by curve 210. In this case the controller may issue a prognosis message indicative of pump leakage corresponding to seal degradation and/or imminent failure when the control gain value decreases to satisfy engine demand as engine RPM increases.

The degraded performance scenarios corresponding to example curve 208 and example curve 210 each have adjusted gain values to about 0.7 at 1500 RPM, however the gain values trend differently as a function of engine RPM. While increasing and decreasing trends are depicted by way of example, control signal gain trends may have a number of different characteristic forms depending to the particular cause of degraded performance. The controller may include one or more algorithms to monitor adjustment trends of control signal gain across ranges of different engine operation parameters to distinguish between causal factors of degraded fuel pump performance.

Figure 5:
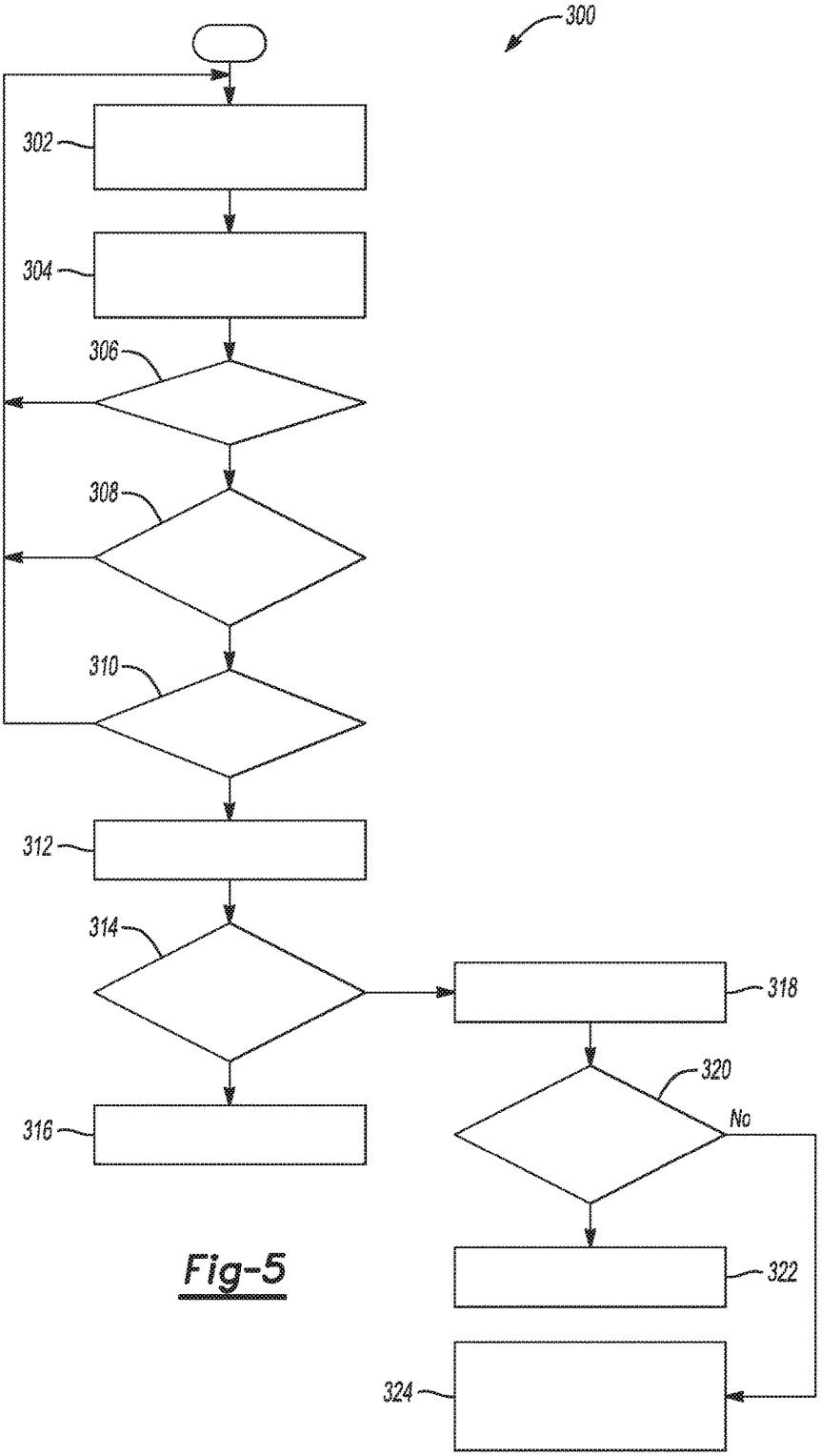
FIG. 5 is a flow chart of a method of generating a fuel pump prognosis.

Referring to FIG. 5, a method 300 of conducting fuel pump prognosis is depicted. At step 302 the controller collects data regarding control signal gains applied to the high-pressure fuel pump and the fuel delivery timing. These data are collected over a range of vehicle operating conditions.

At step 304 the controller normalizes the control signal gains and fuel delivery timing over the range of operating conditions. The normalized values establish baseline operation to which deviations are compared to generate component prognosis.

At step 306 the controller considers whether data provided from the fuel injectors indicates that the injectors are causing a rich fuel-air mix. If the injectors are causing the less than desirable fuel-to-air ratio, additional prognosis of the high-pressure fuel pump may not be required. The controller may continue to collect, normalize, and monitor fuel delivery data concerning the fuel pump.

If at step 306, the fuel injectors are not indicated to be the cause of a rich fuel-air mix, the controller considers whether control signal gains applied to the high-pressure fuel pump are changing. If these data are not changing at step 308, the controller continues the collect, normalize, and monitor data loop.

If at step 308 there is a change over time in control signal gains applied to the high-pressure fuel pump, the controller considers at step 310 whether the control signal gain value has been adjusted by more than a predetermined threshold from the calibrated gain value. If the control signal gains applied to the high-pressure fuel pump are within the threshold at step 310, the controller continues the collect, normalize, and monitor data loop.

If the control signal gains are beyond the threshold at step 310, the controller may collect data regarding the fuel delivery rate of the low-pressure supply pump at step 312. At step 314 the controller considers whether the supply fuel pump is delivering more fuel than an amount corresponding to a normalized rate of delivery. If the rate is increase to exceed a rate delivery threshold at step 314, the condition may be indicative of fuel pump leakage. The increase in the fuel supply rate may be a symptom of increased demand to compensate for pressure loss due to pump leakage. In this way, the controller may use outputs from both of the low-pressure supply fuel pump as well as the high-pressure fuel pump in order to conduct a prognosis of the high-pressure fuel pump. At step 316 the controller issues a prognosis warning message indicative of fuel pump leakage.

If at step 314 the low-pressure supply fuel pump is delivering fuel at a rate within the rate delivery threshold the controller may consider other data pertaining to the fuel pump to generate a prognosis. At step 318, the controller collects data regarding solenoid inlet valve feedback current. If at step 320 the solenoid feedback current is increasing relative to normalized values, it may be indicative of solenoid wear. If the feedback current is increased from the normalized value beyond a feedback current threshold, the controller issues at step 322 a prognosis message indicative of solenoid wear.

If at step 320 the solenoid feedback current is within the feedback current threshold, the elevated gain value may be a symptom of degradation of other fuel delivery components. If the solenoid feedback current is not increasing, the solenoid may not be the cause of the increased control signal gains. The condition may indicate a fuel flow restriction within the high-pressure fuel pump. For example, either the pressure relief valve or the check valve may be fully or partially stuck causing the controller to increase control signal gain value to compensate. At step 324 the controller issues a prognosis warning message indicative of a flow restriction of the check valve or pressure relief valve.

The processes, methods, or algorithms disclosed herein can be deliverable to, and/or implemented by a processing device, controller, or computer, which can include any existing programmable electronic control unit or dedicated electronic control unit. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components. Such example devices may be on-board as part of a vehicle computing system or be located off-board and conduct remote communication with devices on one or more vehicles.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and can be desirable for particular applications.

What is claimed is:

1. A fuel delivery system comprising:

a fuel pump having a pumping chamber to increase fuel pressure and a closeable inlet valve;

a fuel rail to communicate pressurized fuel received from the fuel pump to at least one engine cylinder; and a controller programmed to issue a control signal to periodically close the inlet valve to generate a setpoint fuel pressure within the pumping chamber, adjust a control signal gain value in response to deviation in an outlet fuel pressure relative to the setpoint fuel pressure, and issue a warning message in response to the signal gain being adjusted by more than a predetermined threshold from a calibrated gain value, wherein the calibrated gain value is set based on fuel demand corresponding to normalized engine operating conditions when the fuel pump is substantially new.

2. The fuel delivery system of claim 1 wherein the warning message indicates fuel pump leakage in response to a supply rate from a fuel supply pump being greater than a rate delivery threshold.

3. The fuel delivery system of claim 1 wherein the warning message indicates fuel pump leakage in response to an adjustment trend of the control signal gain value as a function of an increase in a RPM of the engine.

4. The fuel delivery system of claim 1 wherein the warning message indicates degradation of a solenoid of the inlet valve in response to an adjustment trend of the control signal gain value as a function of an increase in a RPM of the engine.

5. The fuel delivery system of claim 1 wherein the warning message indicates degradation of a solenoid of the inlet valve in response to an increase in a solenoid feedback current.

6. The fuel delivery system of claim 1 further comprising a low-pressure supply pump to provide fuel to the fuel pump, wherein the warning message indicates a fuel flow restriction of the fuel pump in response to fuel provided to the fuel pump at a rate within a rate delivery threshold and a solenoid feedback current within a feedback current threshold.

7. A method of conducting fuel pump prognosis comprising:

issuing a control signal to periodically actuate a fuel pump solenoid valve based on an engine RPM;

applying a gain value to the control signal to change a timing of actuation of the fuel pump solenoid valve based on a fuel output pressure setpoint corresponding to engine fuel demand;

adjusting the gain value in response to fuel output pressure deviating from the pressure setpoint and in response to degradation in fuel pump solenoid valve actuation response time; and issuing an imminent failure warning message in response to the gain value being adjusted by more than a predetermined threshold.

8. The method of claim 7 further comprising calibrating the gain value based on operating conditions over time, and issuing the imminent failure warning message in response to the gain value being adjusted by more than the predetermined threshold relative to the calibrated gain value.

9. The method of claim 7 wherein the imminent failure warning message indicates fuel pump solenoid valve degradation in response to an adjustment trend of the gain value as a function of an increase in RPM of the engine.

10. The method of claim 7 wherein the imminent failure warning message indicates fuel pump leakage in response to an adjustment trend of the gain value as a function of an increase in RPM of the engine.

11. The method of claim 7 wherein the imminent failure warning message is issued in response to a rate of fuel supplied by a fuel supply pump increasing to greater than a predetermined rate threshold.

12. The method of claim 7 wherein the imminent failure warning message is issued in response to an increase in a solenoid valve feedback current.

13. A direct-inject fuel pump prognosis system comprising:

a solenoid inlet valve operable to regulate a fuel inlet flow into a fuel pump;

a sensor to provide a pressure signal indicative of fuel pressure downstream of the fuel pump; and a controller programmed to issue a control signal to actuate the solenoid inlet valve to create a pressure rise within the fuel pump to satisfy an engine demand, adjust a control signal gain value based on the pressure signal from the sensor, and issue a prognosis message indicative of a fuel pump state of health based on the control signal gain value and indicative of an imminent failure of the fuel pump when the control signal gain value is adjusted by more than a predetermined threshold from a calibrated gain value.

14. The direct-inject fuel pump prognosis system of claim 13 wherein the controller is further programmed to elect a prognosis message type based on control gain value trends as a function of an engine RPM.

15. The direct-inject fuel pump prognosis system of claim 14 wherein the prognosis message type is indicative of solenoid degradation when the control gain value increases to satisfy engine demand as engine RPM increases.

16. The direct-inject fuel pump prognosis system of claim 14 wherein the prognosis message type is indicative of fuel pump leakage when the control gain value decreases to satisfy engine demand as engine RPM increases.

17. The direct-inject fuel pump prognosis system of claim 13 wherein the controller is further programmed to issue a prognosis message indicative of a fuel pump state of health based on an increase in a feedback current from the solenoid inlet valve.

* * * * *